US005446944A

United States Patent [19]

Coleman et al.

[11] Patent Number: 5,446,944

[45] Date of Patent: Sep. 5, 1995

[54] ROCKER LATCH OVERHEAD DOOR HOLDER ASSEMBLY

[75] Inventors: Michael D. Coleman, Indianapolis; Tammy S. Smith, New Palestine; Herman M. Tilly; Theodore J. Fritsch, both of Indianapolis, all of Ind.

[73] Assignee: Von Duprin, Inc., Indianapolis, Ind.

[21] Appl. No.: 137,526

[22] Filed: Oct. 15, 1993

[51] Int. Cl.[6] ..... E05F 5/00

[52] U.S. Cl. ..... 16/85; 16/63; 292/273

[58] Field of Search ..... 16/63–65, 16/49, 82, 85; 292/273, 274, 277, 278; 49/394

[56] References Cited

U.S. PATENT DOCUMENTS 3,601,842 8/1971 Morrison ..... 16/49

*Primary Examiner*—S. Thomas Hughes
*Assistant Examiner*—Kenneth J. Hansen
*Attorney, Agent, or Firm*—Robert F. Palermo; A. James Richardson

[57] ABSTRACT

A door holder assembly, for attachment between a door jamb and a door, to hold the door in an open position includes a jamb bracket attached to the door jamb and a jamb arm pivotally attached to the jamb bracket. A channel assembly having a longitudinally extending channel is attached to the door, and a hold open stop is fixed in the channel of the channel assembly. The hold open stop is configured to have a stop element with a first ramp and a second ramp engageable by a slide assembly. The slide assembly is pivotally attached to the jamb arm and positioned for longitudinal movement in the channel, with the slide assembly having a slide frame configured to support a rocker pivotably connected to the slide frame. The rocker has a catch on one side of a pivot and rocker face on the opposite side of the pivot, with the catch configured to slide over the first ramp for reversible engagement with the second ramp of the stop element to hold the door in an open position. The force required to slide the catch over the first and second ramps is determined by the preload force on an adjustment wedge that engages the rocker face.

7 Claims, 4 Drawing Sheets

ROCKER LATCH OVERHEAD DOOR HOLDER ASSEMBLY

BACKGROUND OF THE INVENTION

This invention relates generally to an apparatus for holding open a door and, more particularly, to a door holder having a shock absorber and an automatically engageable holding feature when the door is swung open to a predetermined angle.

Temporarily holding a door in an open position is often necessary for convenience and safety. One commonly employed method of doing so uses an overhead door control device that includes a pivoting arm attached between an upper portion of a door jamb and an upper part of a door. When the door is to be held open at an angle that does not exceed about 110 degrees, an overhead door control device is efficient, effective, and convenient to install and maintain. Overhead door control devices are less subject to damage by vandalism or accidents, and do not present a potential stumbling hazard.

Automatic door holders with a separate adjustment of the amount of force necessary to disengage the door holder from its held open position are useful. However, many conventional overhead door control devices are difficult to adjust, often requiring special tools or expertise. Even if the door holder is correctly set at installation, with time and wear on the door holder mechanism, the door holder opening angle and force required to disengage the door may change. If the door holder is difficult to accurately set, or if it requires special tools and expertise to adjust, it is likely that the door holder will not be appropriately maintained and will not provide the required convenience and safety. Too many overhead door holders are not durable, are not easy to install and maintain, and are difficult to adjust. Such door holders often require special tools for installation and maintenance and have no provisions to prevent damage from violent or forceful door opening. They also may lack the desired automatic hold-open feature once the door is swung open a predetermined angle, and they may not allow for easy controllable release of the door from its held open position when desired.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door holder assembly, for attachment between a door jamb and a door, for selectively holding the door in an open position, including a jamb bracket attached to the door jamb and a jamb arm pivotally attached to the jamb bracket; a channel assembly having a channel therein and attached to the door; a hold open stop fixed in the channel of the channel assembly, and having a stop element with a first ramp and a second ramp; and a slide assembly pivotally attached to the jamb arm and positioned for longitudinal movement in the channel, the slide assembly having a slide frame configured to support a rocker pivotably connected to the slide frame, the rocker having a catch and rocker face, with the catch configured to slide over the first ramp for reversible engagement with the second ramp of the stop element to hold the door in an open position.

The foregoing and other aspects will become apparent from the following detailed description of the invention when considered in conjunction with the accompanying drawing figures.

DETAILED DESCRIPTION OF THE INVENTION

Figure 1:
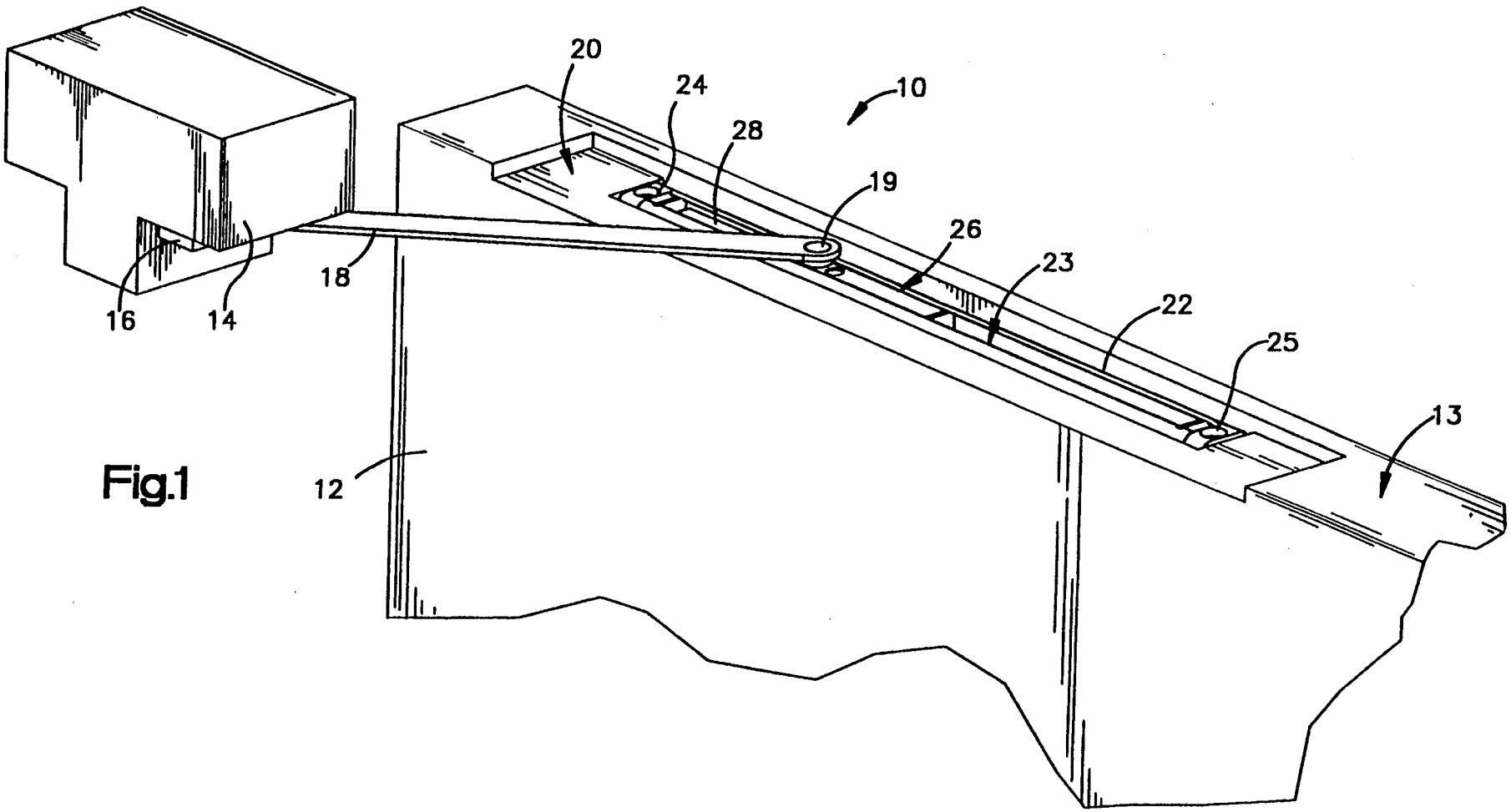
FIG. 1 is a perspective view of a door holder assembly of the present invention.
Figure 7:
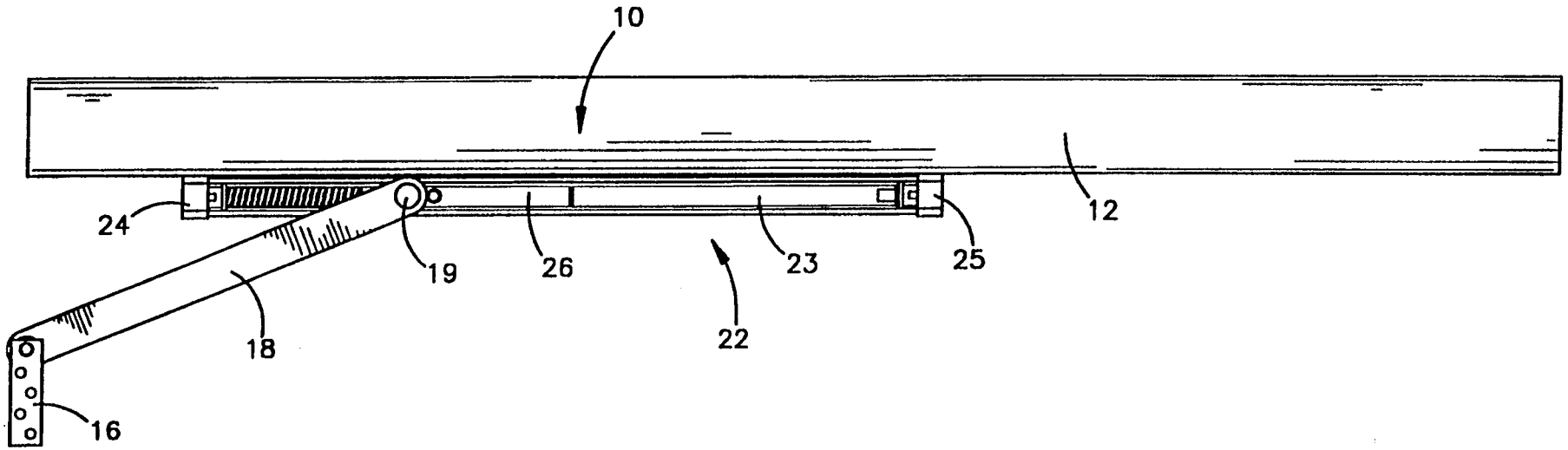
FIG. 7 is a top view of a door holder assembly having its channel assembly attached to a face of a door.

As illustrated in FIG. 1, an overhead holder assembly 10 has a channel assembly 22 positioned in a door inset 20 at an upper edge 13 of a door 12. The channel assembly 22 is attached by first and second end caps 24 and 25 to the door 12 so that its longitudinally extending and generally U-shaped channel 23 is upwardly open. Positioned for sliding movement within the channel 23 and between the end caps 24 and 25 is a slide assembly 26. The door holder assembly 10 also includes a jamb bracket 16 permanently affixed by screws, bolts, rivets, or other fasteners to a door jamb 14. A jamb arm 18 is pivotally connected at one end to the jamb bracket 16 and at its opposite end to the slide assembly. In preferred embodiments, the jamb bracket 16, jamb arm 18 and channel assembly 22 are formed from brass or other durable, wear resistant material such as steel. Advantageously, the overhead holder assembly 10 does not need to be inset into a door for proper operation. An alternative position for mounting the adjustable overhead holder assembly 10 is illustrated by FIG. 7, which shows the channel assembly 22 of the assembly 10 mounted on a face of the door 12 using end caps 24 and 25. Like that embodiment shown in FIG. 1, the U-shaped channel 23 having inserted slide assembly 26 is mounted so that it is upwardly open.

When the door 12 is closed with its upper edge 13 adjacent to the door jamb 14, the slide assembly 26 is positioned in the channel 23 near the end cap 25. As the door 12 is opened, the pivoting connection of the jamb arm 18 between the jamb bracket 16 and the slide assembly 26 allows the slide assembly to move along the channel 23 toward the first end cap 24. As the slide assembly 26 moves toward the first end cap 24, it engages a hold open stop 28 that temporarily and reversibly holds the door in an open position. This held open position is illustrated in FIG. 1, which shows the door 12 in almost wide open state rotated about 100 degrees relative to the door jamb 14.

Figure 2:
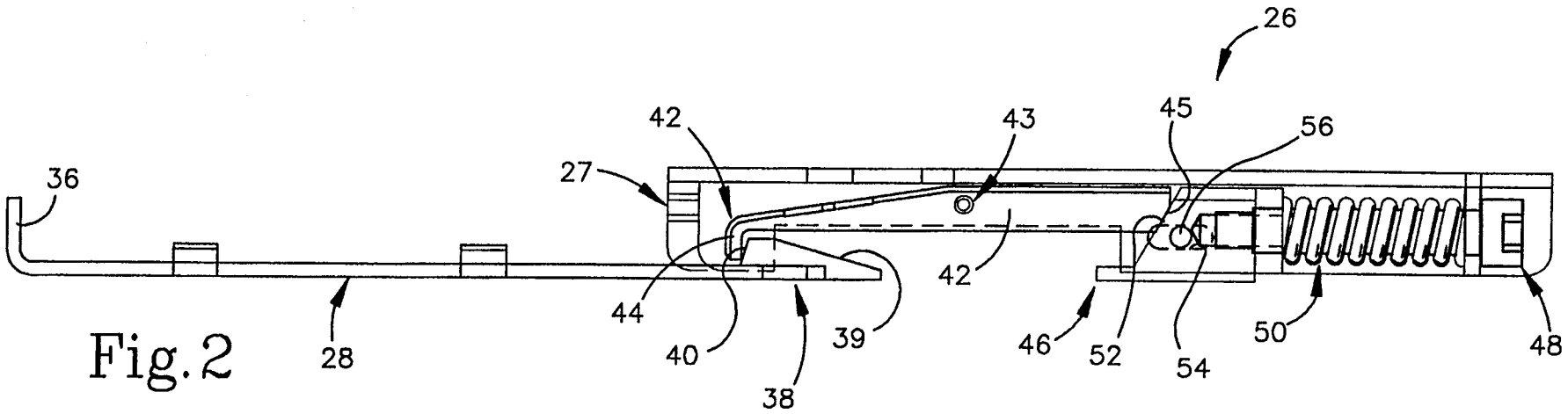
FIG. 2 is a side view of a slide assembly engaged with a hold open stop.

The individual components of the hold open stop 28 and the slide assembly 26 are best illustrated in FIG. 2. The hold open stop 28 is configured for permanent insertion into the channel assembly 22. It has an integrally formed flange 36 that can be snapped into a slot formed in the first end cap 25 for locking engagement.

At its end opposite from the flange 36, the hold open stop 28 has a stop element 38 which has angled and opposed first and second ramps 39 and 40. The first ramp 39 is typically configured to present a wedge shape surface having a dihedral angle of between about 10 degrees to about 40 degrees, with an angle of 25 to 35 degrees being typical. The dihedral angle presented by the second ramp 40 is much steeper, having a range of between about 50 degrees to about 85 degrees, with angles of 65 degrees to 75 degrees being typical.

The stop element 38 engages the slide assembly 26 to hold open the door 12. The slide assembly 26 includes a slide frame 27, an axle pin 43 connected to the slide frame 27 to pivotally support a rocker 42, and an adjustment wedge 46 to permit altering the force exerted by the rocker 42 on the stop element 38 of the hold open stop 28. The adjustment wedge 46 has an internally defined wedge slot 54 through which passes a position pin 56 connected to the slide frame 27. The position of the adjustment wedge 46 is itself adjusted by an adjustment screw 48 that engages a compression spring 50 situated between a head of the screw 48 and the adjustment wedge 46.

Figure 3:
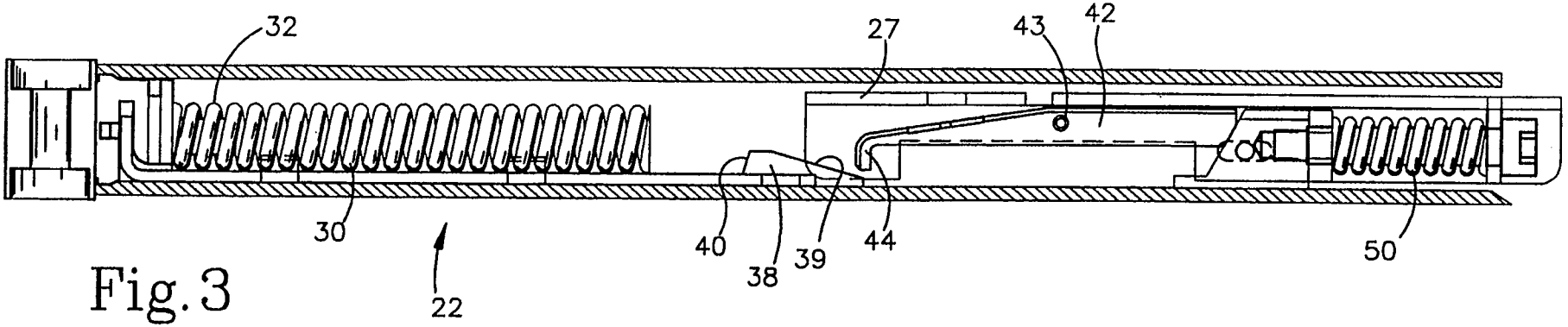
FIG. 3 is a side view of a slide assembly disengaged from the hold open stop.
Figure 4:
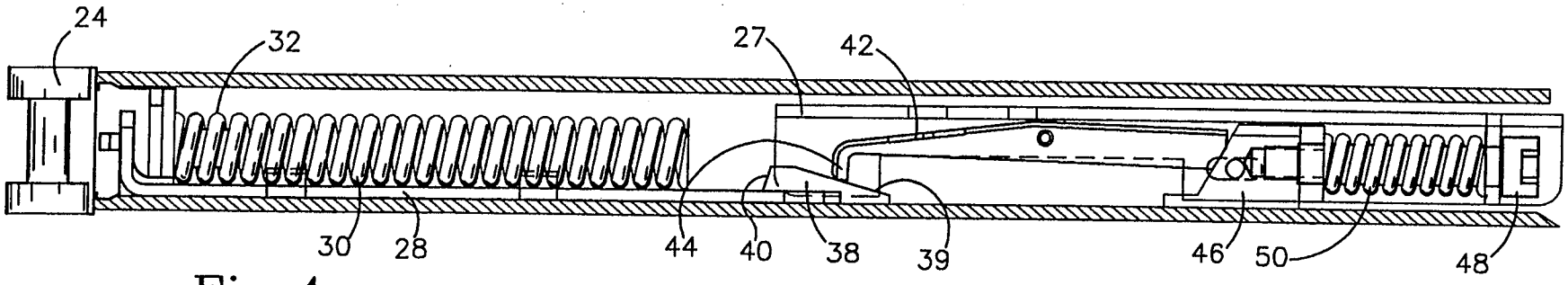
FIGS. 4, 5, and 6 are side views similar to the view of FIG. 3, with the slide assembly shown in progressive stages of engagement with the hold open stop.
Figure 5:
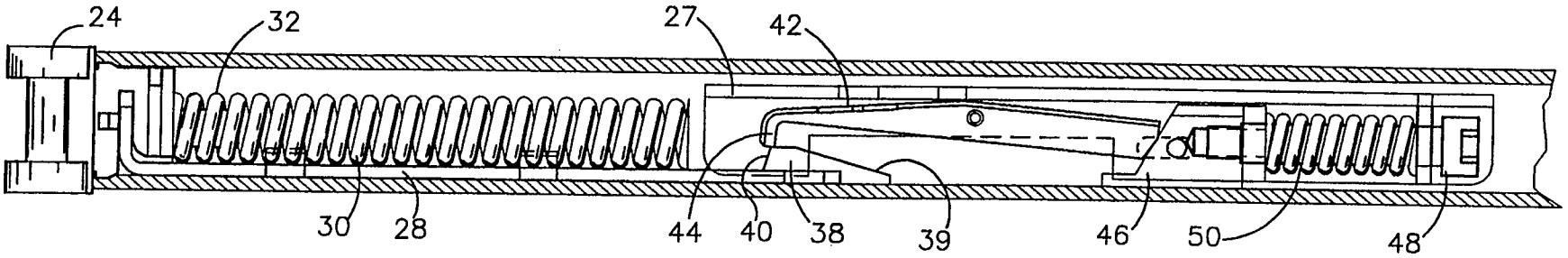
Figure 6:
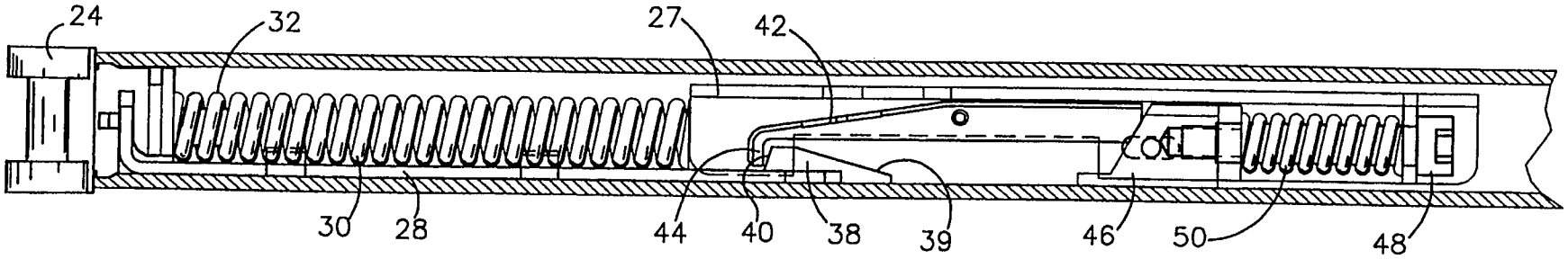

Engagement of the slide assembly 26 and the hold open stop 28 is best illustrated by sequential consideration of FIGS. 3, 4, 5, and 6, which respectively illustrate position of the slide assembly relative to the hold open stop as the door 12 is opened. More particularly, FIG. 3 shows a catch 44 of the rocker 42 just prior to contact with the stop element 38 of the hold open stop 28; FIG. 4 shows the position of the catch 44 on the first ramp 39 of the stop element 38 as the slide assembly moves closer to the hold open stop 28; FIG. 5 shows the position of the catch 44 just prior to sliding down the second ramp 40 of the stop element 38; and FIG. 6 shows the position of the catch 44 in a rest, locked engagement with the second ramp 40 of the stop element 38 with the door in a hold open position. Essentially, a reversal of this sequence is required to disengage the door from the hold open position, however, a greater force is required to pull the catch 44 up the steeper angled second ramp 40 and compared to the force required push the catch 44 up the gentler angled first ramp 39. This difference in required force ensures that the door will remain in a held open position as long as required, while permitting a nearly normal opening force to temporarily lock the door in the hold open position.

The force needed to impel the catch 44 up the first ramp 39 and pull the catch 44 back up the second ramp 40, is modified with the aid of the adjustment wedge 46. When the rocker 42 rotates about the axle pin 43, a rocker face 45 engages a wedge face 52 of the adjustment wedge 46. The necessary rotation of the rocker 42 to allow movement of the catch 44 up the first ramp 39 is resisted by the adjustment wedge 46, with the adjustment wedge being pushed against the compression spring 50 and increasing the resistance to rotation of the rocker 42. The precise force can be easily adjusted with readily available tools by tightening or loosening the adjustment screw to change the position of the compression spring 50 and consequently the position of the adjustment wedge 46. As those skilled in the art will appreciate, although a specific embodiment of an adjustment wedge is described and illustrated, alternative means of resisting rotation of the rocker may also be used, including direct contact of the rocker face with compression or leaf springs, or other known methods for adjustably controlling resistance to rotation.

Another feature of the door holder assembly 10 of the present invention protects the assembly 10 against damage caused by violent opening of the door. A stop spring 30 is positioned in the channel 23 adjacent to the first end cap 24. As best seen in FIGS. 3 through 6, the first end cap is configured to have a centering post 32 that supports the spring 30. When the door is opened far enough, the slide assembly impacts and is slowed by contact with the spring 30. By slowly distributing the force of door opening, the spring 30 prevents shock damage to the assembly 10.

What is claimed is:

1. An adjustable overhead door holder assembly for attachment between a door jamb and a door for selectively holding the door in an open position, the assembly comprising a jamb bracket attachable to a door jamb, a jamb arm pivotally attached to the jamb bracket, a channel assembly attachable to a door, the channel assembly having a channel therein, a hold open stop fixably held in the channel of the channel assembly, the hold open stop having a stop element with a first ramp and a second ramp, and a slide assembly pivotally attached to the jamb arm and positioned for longitudinal movement in the channel, the slide assembly having a slide frame, a rocker pivotably connected to the slide frame, the rocker having a catch and a rocker face, the catch being configured to slide over the first ramp for reversible engagement with the second ramp of the stop element to hold the door in an open position, an adjustment wedge having a wedge face positioned to contact with the rocker face and a slot through the adjustment wedge, a position pin passing through the slot and attached to the slide frame to provide a predefined limited range of movement of the adjustment wedge with respect to the slide frame and the rocker, and biasing means for adjustably biasing the adjustment wedge toward the rocker face to maintain continuous contact therebetween as the adjustment wedge moves within the predefined limited range of movement in response to pivotal movement of the rocker as the catch moves across the hold open stop.

2. The adjustable overhead door assembly of claim 1, wherein the biasing means comprises a compression spring biasably connected between the adjustment wedge and the slide frame to resist movement of the adjustment wedge as the catch of the rocker moves along the first ramp.

3. The adjustable overhead door assembly of claim 2, wherein the biasing means further comprises an adjustment screw configured to hold the compression spring and attached to the slide frame to allow adjustment of bias of the compression spring.

4. The adjustable overhead door assembly of claim 1, wherein the hold open stop further comprises a stop spring and a centering post for retention of the stop spring, the stop spring being positioned to resist compression and absorb door opening force as the slide frame contacts the stop spring.

5. An adjustable overhead door holder assembly for attachment between a door jamb and a door having an upper door edge, the assembly comprising a jamb arm and means for pivotally attaching the jamb arm to a door jamb, a channel assembly attachable to a door so that the channel assembly extends parallel to an upper door edge, the channel assembly having an upwardly opening channel defined therein, door holding means positioned within the channel assembly, the door holding means having a stop element with a first ramp and a second ramp for holding a door, sliding means pivotally attached to the jamb arm and positioned for Sliding longitudinal movement within the channel, the sliding means having a slide frame, a pivot mount, a pivotally mounted rocker connected to the slide frame by the pivot mount, the rocker terminating in a catch on a first side of the pivot mount and terminating in a rocker face on an opposite side of the pivot mount, the catch being configured to slide over the first ramp for reversible engagement with the second ramp of the stop element to hold the door in an open position, an adjustment wedge having a wedge face, the adjustment wedge being positioned in contact with the rocker face and reacting to the position of the rocker catch with respect to the stop element, the adjustment wedge including a wedge slot therethrough, and a position pin attached through the wedge slot to the slide frame to provide a predefined limited range of movement of the adjustment wedge with respect to the slide frame in response to any pivotal movement of the rocker.

6. The adjustable overhead door assembly of claim 5 further comprising a compression spring biasably connected between the adjustment wedge and the slide frame to resist movement of the adjustment wedge as the catch of the rocker moves along the first ramp.

7. The adjustable overhead door assembly of claim 6, further comprising an adjustment screw configured to hold the compression spring and attached to the slide frame to allow adjustment of bias of the compression spring.

* * * * *